United States Patent [19]

Tabakov et al.

[11] Patent Number: 4,872,021

[45] Date of Patent: Oct. 3, 1989

[54] COLLINEAR DIPOLE ARRAY WITH INDUCTIVE AND CAPACITIVE PHASING

[75] Inventors: Mirtcho S. Tabakov; Nedyalko K. Nedyalkov; Stefan T. Stefanov, all of Sofia, Bulgaria

[73] Assignee: "MIRTA", Sofia, Bulgaria

[21] Appl. No.: 167,668

[22] Filed: Mar. 14, 1988

[30] Foreign Application Priority Data

Mar. 12, 1987 [BG] Bulgaria ..... 78857

[51] Int. Cl.[4] ..... H01Q 11/16; H01Q 21/10

[52] U.S. Cl. ..... 343/801; 343/810; 343/827

[58] Field of Search ..... 343/801, 802, 810, 813, 343/816, 820, 827, 747, 792, 722, 749, 752, 816, 891

[56] References Cited

U.S. PATENT DOCUMENTS

| | | | |
|---|---|---|---|
| 1,874,983 | 8/1932 | Hansell | 343/801 |
| 1,966,491 | 7/1934 | Ferrell | 343/722 |
| 2,667,577 | 1/1954 | Graziano | 343/801 |
| 3,016,536 | 1/1962 | Fubini | 343/801 |

*Primary Examiner*—Rolf Hille
*Assistant Examiner*—Michael C. Wimer
*Attorney, Agent, or Firm*—Klein & Vibber

[57] ABSTRACT

The antenna represents colinearly arranged half-wave dipoles. On the side of each final half-wave dipole is a quarter-wave dipole. The connection between the dipoles is alternately capacitive and inductive each providing a phase shift within the range of from 60 to 120 electrical degrees. The terminal of the antenna is asymmetrically deduced from the free end of one of the final half-wave dipoles and the adjacent end of the nearby quarter-wave dipole. This antenna can be used in reception and transmission of electromagnetic energy and shows a considerably increased gain.

4 Claims, 2 Drawing Sheets

COLLINEAR DIPOLE ARRAY WITH INDUCTIVE AND CAPACITIVE PHASING

FIELD OF THE INVENTION

This invention concerns an antenna used for reception and transmission of electromagnetic energy.

BACKGROUND OF THE INVENTION

There is a known antenna (Rothamel, Karl, *Antenna Manual*, Sofia 1977) which comprises at least two half-wave dipoles disposed one beside the other on one axis. Each two adjacently disposed half-wave dipoles are connected to the terminals of an inductive circuit which provides a current phase shift of approximately 180° electrical degrees while the distance between them is [lambda]/8. The free end of one of the final half-wave dipoles is the active antenna terminal.

The disadvantage of this known antenna is its low effectiveness as expressed in the insufficient gain.

Thus, it is an object of the invention to provide an antenna having an increased gain.

SUMMARY OF THE INVENTION

This object is achieved by an antenna comprising "n" pairs of half-wave dipoles disposed on one axis so that the half-wave dipoles of each pair are connected with a corresponding inductive circuit. The active terminal of the antenna is deduced from the free end of one of the final half-wave dipoles. According to the invention, on the free side of both final half-wave dipoles, one quarter wave dipole is disposed and the passive terminal of the antenna is deduced from the end of the quarter-wave dipole adjacent to the active terminal. The connections between the pairs of half-wave dipoles, as well as the connections between the final half-wave dipoles and the respective quarter-wave dipoles are capacitive connections.

The current phase shift of the inductive circuits can range from 60 to 120 electrical degrees. The voltage phase shift of the capacitive connections can also range from 60 to 120 electrical degrees. however, it is recommended that the two phase shifts be approximately 90 electrical degrees.

The advantages of this antenna is its increased effectiveness as expressed in a higher gain and the increased efficiency of the antenna surface.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
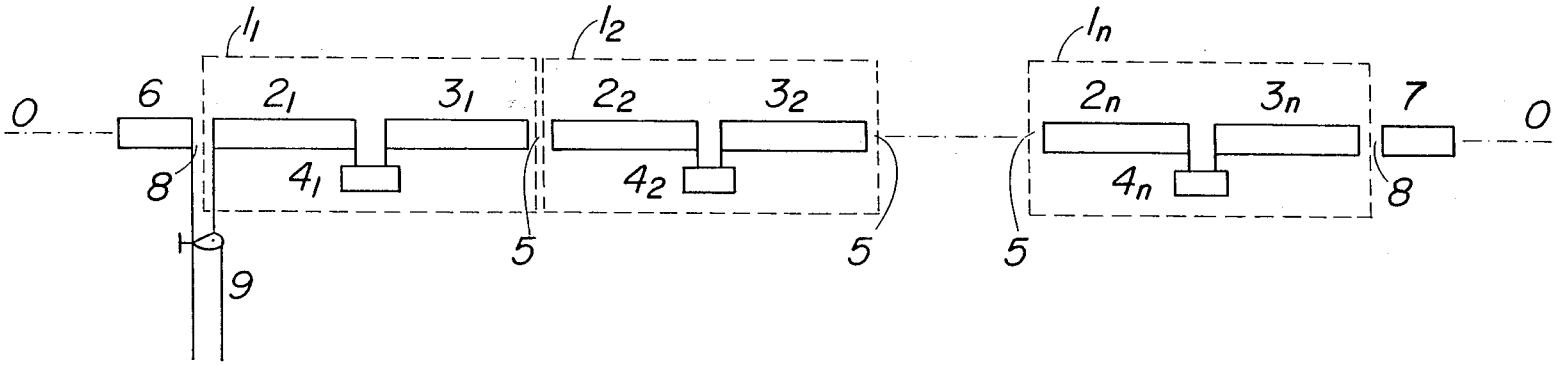
FIG. 1 is a schematic diagram of the principle of the inventive antenna with "n" pairs of half-wave dipoles.

The antenna according to FIG. 1 comprises "n" pairs $1_1, 2_2, \ldots, 1_n$ of half-wave dipoles $2_1$-$3_1$, $2_2$-$3_2$, . . . , $2_n$-$3_n$, disposed on one axis O—O. The half-wave dipoles $2_1$-$3_1$, $2_2$-$3_2$, . . . , $2_n$-$3_n$ of the corresponding pairs $1_1, 1_2, \ldots, 1_n$ are connected with their near ends to a respective inductive circuit $4_1, 4_2, \ldots, 4_n$ which provides a current phase shift within the range of 60 to 120 electrical degrees. Between the separate pairs $1_1$, $1_2$, . . . , $1_n$ exists a capacitive connection 5 which provides a voltage phase shift within the range of 60 to 120 electrical degrees.

On the external side of each of the final half-wave dipoles $2_1$, $3_n$, one quarter-wave dipole 6, 7 is disposed on the same axis O—O. The connection 8 of each quarter-wave dipole 6, 7 with the respective adjacent half-wave dipole $2_1$, $3_n$ is a capacitive connection which provides a voltage phase shift within the range of 60 to 120 electrical degrees. The free end of the first half-wave dipole $2_1$ is the active terminal of the antenna which is connected to an inner conductor of coaxial line 9 while the passive terminal of the antenna is the adjacent end of the quarter-wave dipole 6 that is connected with the grounded outer conductor of coaxial line 9. The terminals of the antenna can also be lead from the free end of the final half-wave dipole $3_n$ and its adjacent end of quarter-wave dipole 7 in a similar manner.

Figure 2:
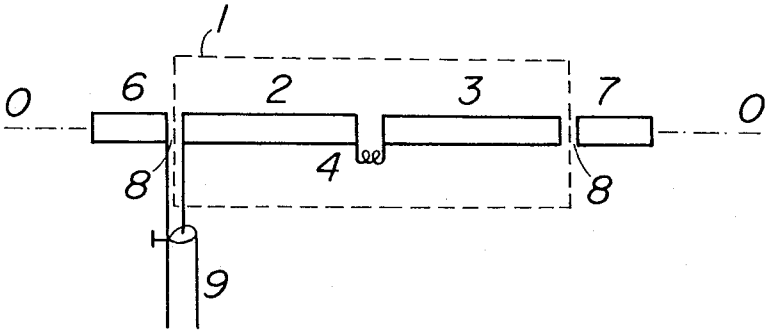
FIG. 2 is a schematic diagram of the antenna with one pair of half-wave dipoles.

The antenna according to FIG. 2 comprises one pair 1 of half-wave dipoles 2-3, connected by an inductive circuit 4 which provides a current phase shift within the range of 60 to 120 electrical degrees that is shown as a coil. At each end of the pair 1 on the same axis O—O, a quater-wave dipole 6, 7, respectively, is disposed. The quarter-wave dipoles are connected to pair 1 by capacitive connections 8 which provides a voltage phase shift within the range of 60 to 120 electrical degrees that is, e.g., created by the air interspace between the quarter-wave dipoles 6, 7 and their respective adjacent half-wave dipoles 2, 3. The active terminal of the antenna is deduced from the free end of the half-wave dipole 2 while the passive terminal is deduced from the adjacent end of the quarter-wave dipole 6. The active terminal can also be taken from the free end of half-wave dipole 3 while the passive can be taken from an adjacent end of quarter-wave dipole 7.

By means of different variants of this antenna, multiple antenna systems can be realized.

The antenna operates both under conditions of reception or of emission of electtromagnetic energy. It represents a colinear row of half-wave dipoles with alternating capacitive and inductive connections between them, both providing a phase shift within the range of from 60 to 120 electrical degrees. The quarter-wave dipoles 6, 7 fulfill the function of matching elements.

By means of an antenna having one pair of half-wave dipoles as shown on FIG. 2 with phase shift of the inductive and capacitive connections of 90 electrical degrees in the meter range for frequencies from 160 MHz to 200 MHz, a gain of 5.7 dB is attained for a frequency of 168 MHz with respect to the half-wave dipole. In the decimeter range for frequencies from 450 MHz to 540 MHz, a gain of 4.4 dB is attained for a frequency of 525 MHz with respect to the half-wave dipole.

The gains for different variants of the antenna according to this invention are given in comparison with those of a prior art antenna in Table 1.

TABLE 1

| | Number of dipoles | | | | |
|---|---|---|---|---|---|
| | three | | five | seven | nine |
| | VARIANTS | | | | |
| Antenna | 160–200 MHz | 450–540 MHz | | | |
| | GAIN | | | | |
| accord to | 5.7 | 4.4 | appr. | appr. | appr. |

TABLE 1-continued

| | Number of dipoles | | | | |
|---|---|---|---|---|---|
| | three | | five | seven | nine |
| invention with phase shift of 90 degrees | 168 MHz | 525 MHz | 8.5 | 9.4 | 10.5 |
| Prior Art Antenna | 3.2 | | 5.8 | 6.9 | 7.5 |

In the above comparison, the length of the quarter-wave dipoles of the inventive antenna was accounted for by comparing the prior art antenna having 3 half-wave dipoles with the inventive antenna having 2 half-wave dipoles and 2 quarter-wave dipoles, for example, and so on with respect to five, seven and nine dipoles of the prior art antenna.

The analysis of this data shows that, in presence of equal linear size, the antenna according to the invention surpasses the prior art antenna in gain.

As described above, the terminal of the antenna permits a direct connection to a coaxial line.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An antenna comprising a plurality of pairs of half-wave dipoles disposed end to end on one common axis;

a corresponding plurality of inductive circuits, the half-way dipoles of each pair being connected by a respective one of said inductive circuits;

a free end of a final one of said half-wave dipoles being the active terminal of the antenna;

two quarter-wave dipoles, each quarter-wave dipole being disposed at a respective end of said common axis adjacent a free end of one of said half-wave dipoles;

an end of the respective quarter-wave dipole adjacent to said active terminal being the passive terminal of the antenna;

the pairs being connected to each other and to said quarter-wave dipoles by capacitive connections;

both said inductive circuits and said capacitive connections providing a phase shift within the range of from 60 to 120 electrical degrees.

2. An antenna as claimed in claim 1, wherein the inductive circuits provide a current phase shift of approximately 90 electrical degrees.

3. An antenna as claimed in claim 1, wherein:

the capacitive connections provide a voltage phase shift of approximately 90 electrical degrees.

4. An antenna as claimed in claim 2, wherein:

the capacitive connections provide a voltage phase shift of approximately 90 electrical degrees.

* * * * *